US008651906B1

(12) United States Patent
Morton

(10) Patent No.: US 8,651,906 B1
(45) Date of Patent: Feb. 18, 2014

(54) OUTBOARD MOTORS AND APPARATUSES FOR INTAKE OF AIR TO OUTBOARD MOTORS

(75) Inventor: Scott C. Morton, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 301 days.

(21) Appl. No.: 13/220,374

(22) Filed: Aug. 29, 2011

(51) Int. Cl.
*B63H 21/36* (2006.01)

(52) U.S. Cl.
USPC ..... 440/77; 440/88 A; 440/88 R

(58) Field of Classification Search
USPC ..... 440/77, 88 A, 88 R
See application file for complete search history.

(56) References Cited

U.S. PATENT DOCUMENTS 3,615,017 A * 10/1971 Valdespino ..... 210/242.3
6,752,240 B1 * 6/2004 Schlagenhaft ..... 181/249
6,899,579 B1 * 5/2005 Bruestle ..... 440/88 A
6,964,255 B2 * 11/2005 Shomura et al. ..... 123/198 E
7,021,262 B1 * 4/2006 Belter et al. ..... 123/184.47
7,238,069 B2 * 7/2007 Ito et al. ..... 440/77
7,247,065 B2 * 7/2007 Ito ..... 440/77
7,252,568 B2 * 8/2007 Ito et al. ..... 440/77
7,267,591 B2 * 9/2007 Kimura et al. ..... 440/77
7,452,256 B2 * 11/2008 Kasai et al. ..... 440/88 A
7,524,223 B2 * 4/2009 Ochiai et al. ..... 440/88 R
7,524,224 B2 * 4/2009 Ide et al. ..... 440/88 A
7,572,159 B2 * 8/2009 Ide et al. ..... 440/88 A
7,806,741 B1 * 10/2010 Baier et al. ..... 440/88 A
2003/0127376 A1 * 7/2003 Maddock et al. ..... 210/114
2006/0258235 A1 * 11/2006 Kimura et al. ..... 440/77

* cited by examiner

*Primary Examiner* — Lars A Olson
*Assistant Examiner* — Jovon Hayes
(74) *Attorney, Agent, or Firm* — Andrus Intellectual Property Law, LLP

(57) ABSTRACT

An apparatus for intake of air to an outboard motor includes an inlet receiving a mixture of air and water from atmosphere surrounding the outboard motor and an outlet discharging the air. A conduit extends between the inlet and the outlet. The conduit has a vertically downwardly oriented first flow path, a vertically upwardly oriented second flow path, and a junction joining the first and second flow paths. The junction is oriented with respect to the first and second flow paths such that both centrifugal and gravitational forces separate the water from the air as the mixture flows therethrough.

15 Claims, 4 Drawing Sheets

OUTBOARD MOTORS AND APPARATUSES FOR INTAKE OF AIR TO OUTBOARD MOTORS

FIELD

The present disclosure relates to outboard motors for marine vessels and more particularly to apparatuses for intake of air to outboard motors.

BACKGROUND

U.S. Pat. No. 7,247,065 discloses an outboard motor including an engine for driving a propulsion device, a cowling for covering the engine, a fresh air intake opening formed in the cowling for drawing fresh air, and an engine compartment defined in the cowling. The outboard motor has a bottom part defined below the engine compartment, a water collecting part disposed below the bottom part for receiving water that entered the cowling, a water passage for communicating the bottom part and the water collecting part, and a drain hole formed in a bottom portion of the water collecting part.

U.S. Pat. No. 7,524,223 discloses an outboard motor having an apparatus for separating water and air sucked in from an intake port. The outboard motor includes a cowling, a right-side intake port, a left-side intake port, first and second water separating portions, a communication port, and an engine compartment. The right-side intake port is formed in a right side surface portion of an upper portion of the cowling. The left-side intake port is formed in a left side surface portion of the upper portion of the cowling. The first water separating portion has an intake passage communicating between the right-side intake port and the left-side intake port. The second water separating portion communicates with the first water separating portion through the communication port, and the second water separating portion communicates with the engine compartment.

U.S. Patent Application Publication No. 2006/0258235 discloses an outboard motor including an engine having an air intake device. A cowling has an internal space in which the engine is disposed and an air intake opening through which ambient air is introduced into the internal space. The internal space defines an air intake passage connecting the air intake opening of the cowling to the air intake device of the engine. An air/water separator is disposed within the air intake passage for separating water from the air. The air/water separator has a relative large volume so as to temporarily hold water from a sudden flow of water that may flow into the cowling air intake. Water accumulated in the separator is drained from the cowling.

SUMMARY

The present disclosure results from research and development of improved air intake apparatuses for marine propulsion systems, including outboard motors.

In one example, an apparatus for intake of air to an outboard motor includes an inlet receiving a mixture of air and water from atmosphere surrounding the outboard motor and an outlet discharging the air to a space between the cowl and the internal combustion engine. A conduit extends between the inlet and the outlet. The conduit has a vertically downwardly oriented first flow path, a vertically upwardly oriented second flow path, and a junction joining the first and second flow paths. The junction is oriented with respect to the first and second flow paths such that both centrifugal and gravitational forces separate the water from the air as the mixture flows therethrough.

A baffle can separate the first flow path from the second flow path and have a lower end portion located at the junction. A separator can be located at the junction for separating the water from the air and can include a drain and a wall having a free end laterally extending into the junction. A sponge can also be disposed in the conduit for coalescing water from the mixture.

In another example, an outboard motor comprises an internal combustion engine; a cowl covering the internal combustion engine; and port and starboard apparatuses for intake of air to an outboard motor. Each apparatus has an inlet receiving a mixture of air and water from atmosphere surrounding the outboard motor and an outlet discharging the air to a space between the cowl and the internal combustion engine. A conduit extends between the inlet and the outlet. The conduit has a vertically downwardly oriented first flow path, a vertically upwardly oriented second flow path, and a junction joining the first and second flow paths. The junction is oriented with respect to the first and second flow paths such that both centrifugal and gravitational forces separate the water from the air as the mixture flows therethrough.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. The different devices described herein may be used alone or in combination with other devices. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
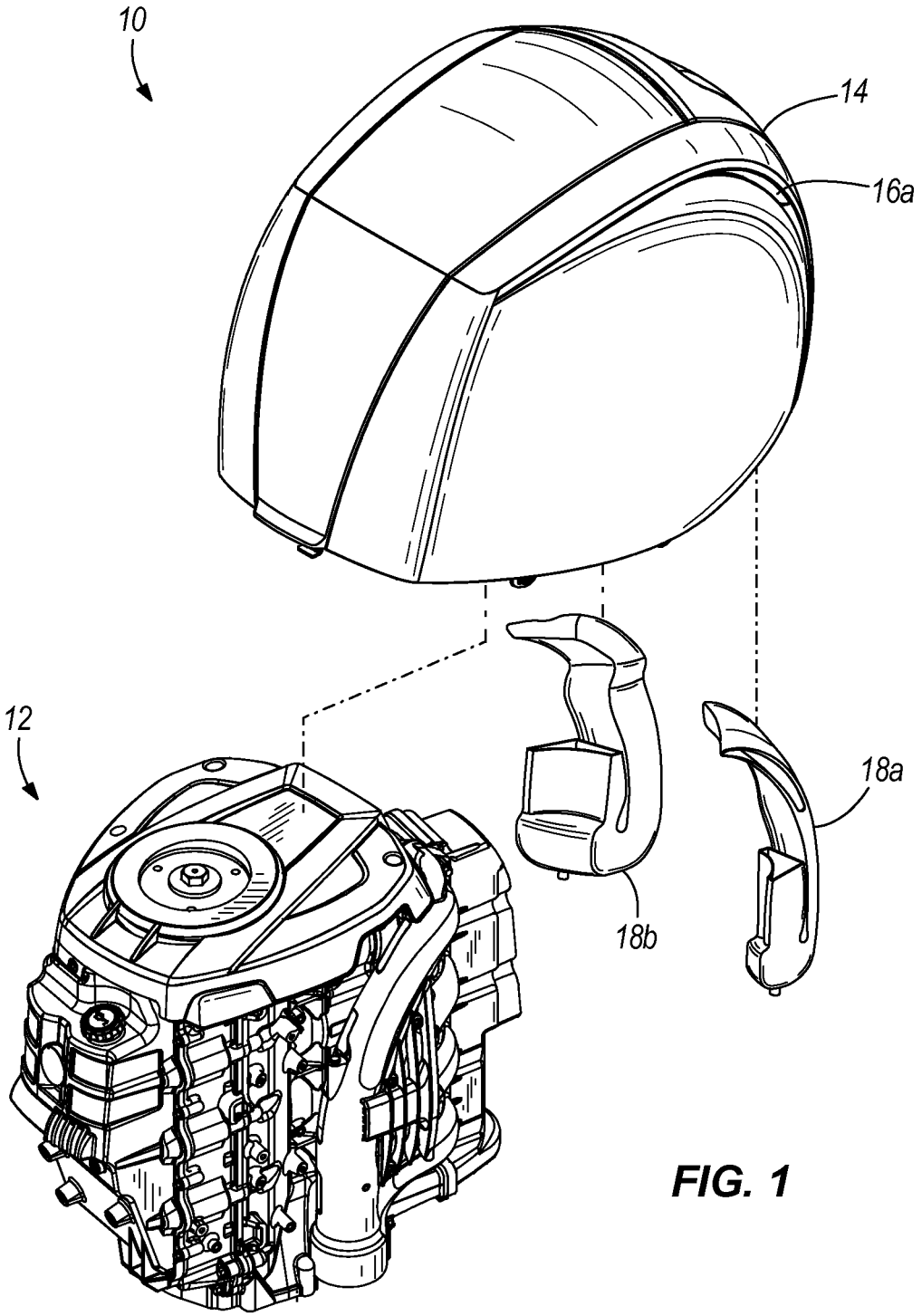
FIG. 1 is an exploded perspective view of portions of an outboard motor including an internal combustion engine, a cowl covering the internal combustion engine, and port and starboard apparatuses for intake of air to the internal combustion engine.

FIG. 1 depicts portions of an outboard motor 10 including an internal combustion engine 12 and a cowl 14 covering the internal combustion engine 12. The internal combustion engine 12 receives combustion air via inlets 16*a* (FIG. 1), 16*b* (FIG. 2) formed in cowl 14. The combustion air often contains a mixture of air and water from the atmosphere surrounding the outboard motor 10. The water can pose significant problems for the outboard motor 10. It can splash onto the exterior surfaces of the hot power head, creating unsightly salt and mineral deposits and corrosion. The water can also damage sensitive electrical components and cause corrosion or salt deposit build-up. In addition, the water can enter the throttle body of the engine 12, which leads directly to the combustion chamber. If this occurs, serious damage can be incurred by the engine 12.

Figure 2:
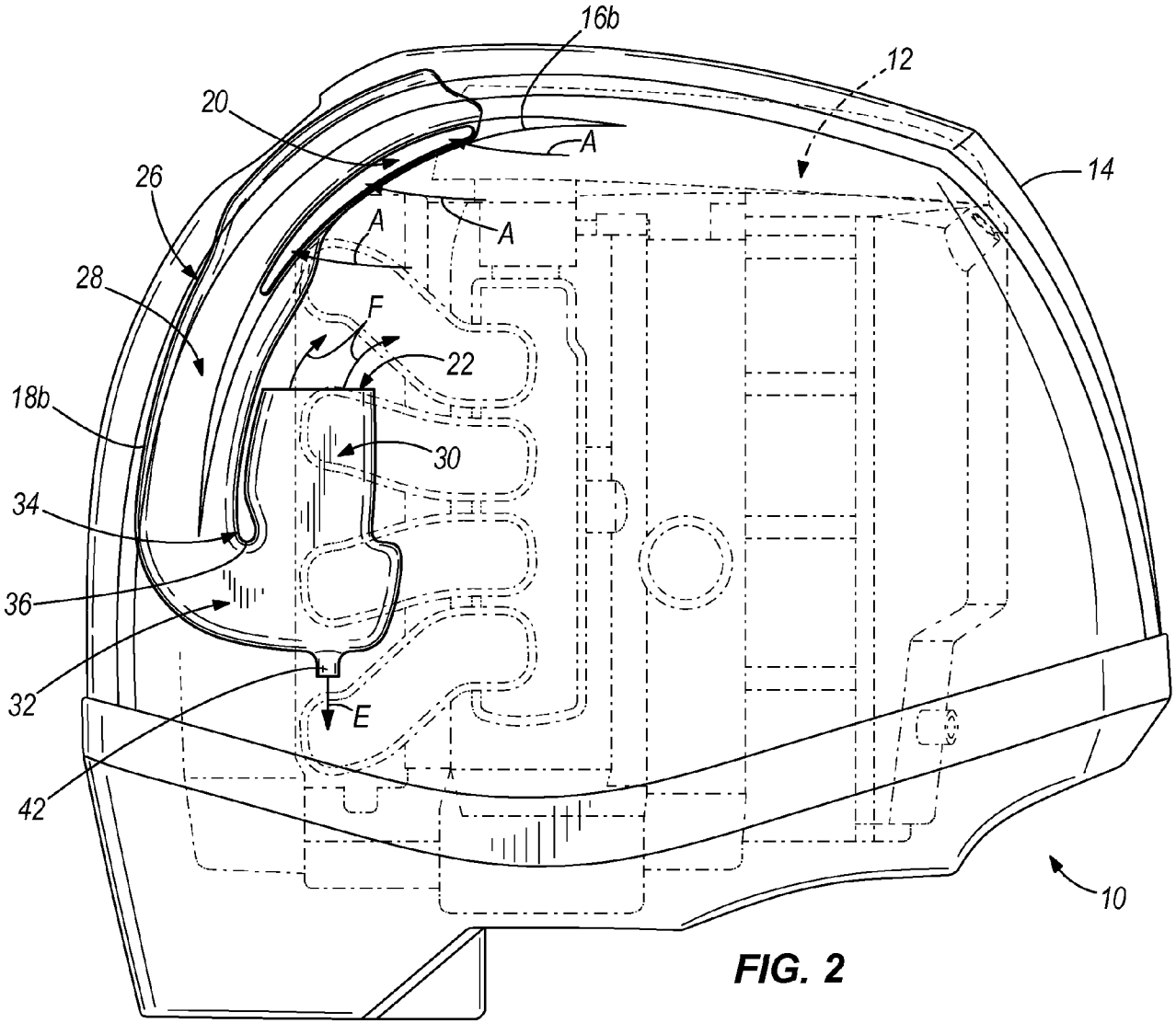
FIG. 2 is a side view of the portions of the outboard motor, showing the cowl and an apparatus for intake of air in solid line and showing the internal combustion engine in phantom line.
Figure 3:
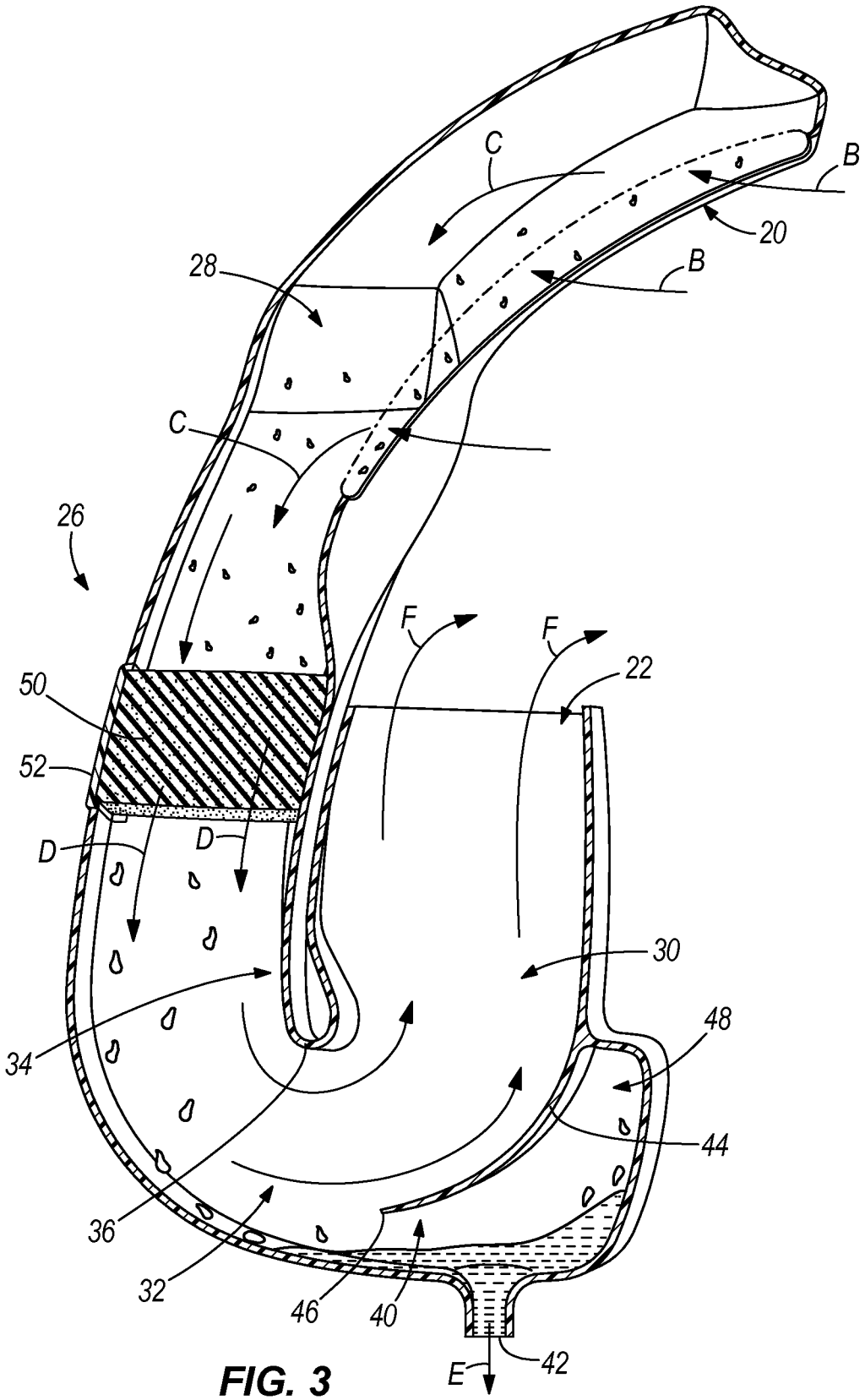
FIG. 3 is a side sectional view of the apparatus for intake of air showing flow of a mixture of air and water therethrough.
Figure 4:
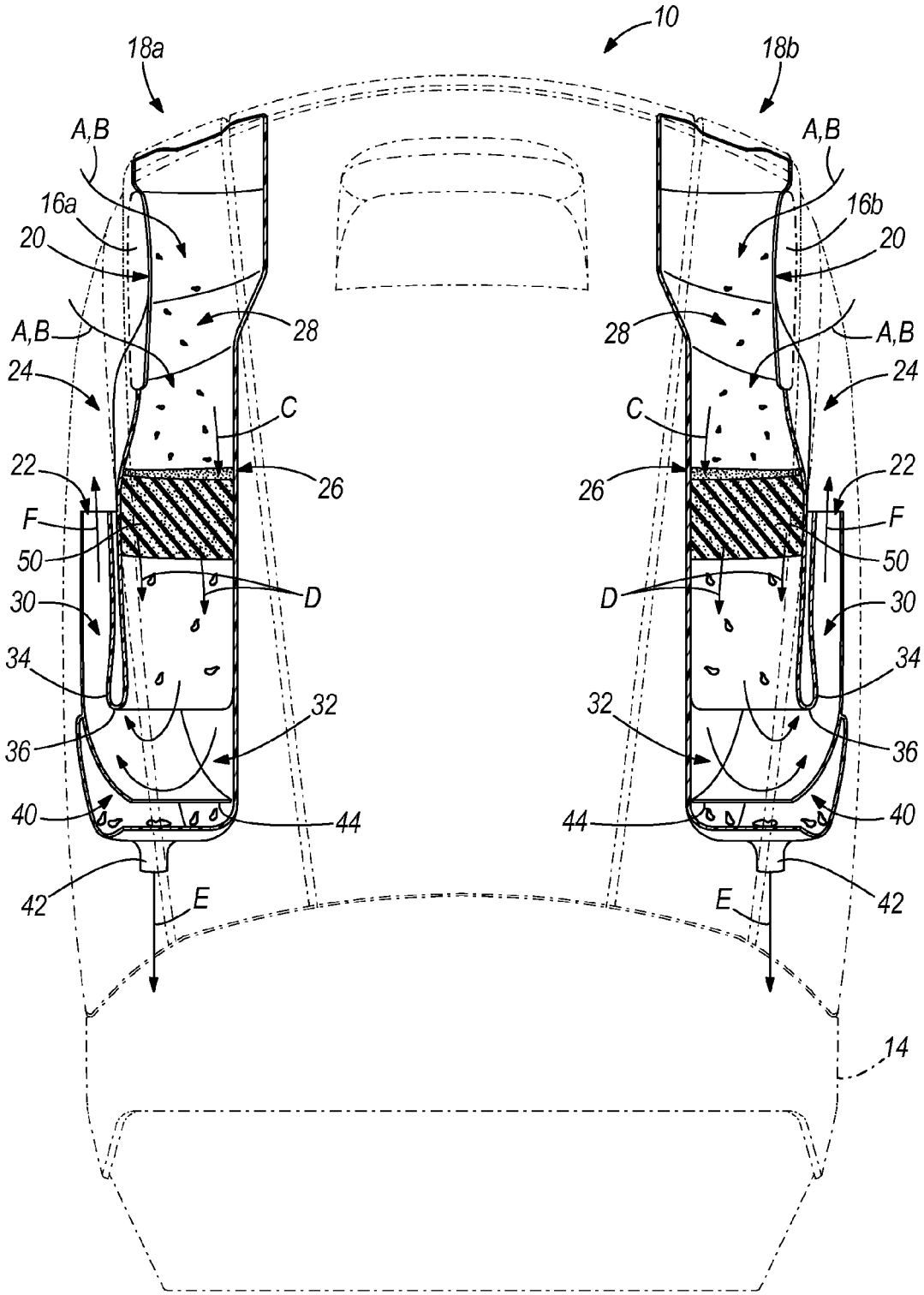
FIG. 4 is an end sectional view of the outboard motor showing the apparatuses for intake of air in solid line and showing the cowl in phantom line.

To overcome these problems, the outboard motor 10 shown in FIG. 1 is provided with port and starboard apparatuses 18*a*, 18*b* for intake of the mixture of air and water to the outboard motor 10 and separation of the water therefrom. The apparatuses 18*a*, 18*b* are mirror images of each other and are disposed on opposite sides (i.e. port and starboard sides) of the motor 10 between the internal combustion engine 12 and cowl 14. As shown in FIGS. 2-4, each apparatus 18*a*, 18*b* has an inlet 20 receiving the mixture of air and water from atmosphere surrounding the outboard motor 10 via the inlets 16*a*, 16*b*, respectively. Each apparatus 18*a*, 18, also has an outlet 22 discharging the air to a space 24 (see FIG. 4) located between the internal combustion engine 12 and cowl 14 for later intake by the internal combustion engine 12 for the combustion process. A conduit 26 extends between the inlet 20 and outlet 22. The conduit 26 has a vertically downwardly oriented first flow path 28, a vertically upwardly oriented second flow path 30, and a junction 32 joining the first and second flow paths 28, 30 together. In the example shown, the junction 32 includes a 180-degree bend; however, other configurations at a lesser or greater degree bend could be employed. The junction 32 is oriented below the vertically downwardly oriented first and vertically upwardly oriented second flow paths 28, 30 such that both centrifugal and gravitational forces cause the water to separate from the air as the mixture flows therethrough. This effect will be further explained herein below.

A baffle 34 separates the first flow path 28 from the second flow path 30. The baffle 34 has a lower end portion 36 that has a curved outer surface for guiding air flow around and through the junction 32 from the first flow path 28 to the second flow path 30. A separator 40 is located at the junction 32 and further facilitates separation of the water from the mixture. In the example shown, the separator 40 includes a drain 42 and a wall 44 having a free end 46 laterally extending into the junction 32. The drain 42 is disposed lower than the wall 44 in the apparatuses 18*a*, 18*b* and receives and drains water from the separator 40. This effect will be further explained herein below.

A water trap 48 is located in the apparatuses 18*a*, 18*b* at a location that is at least partially vertically higher than the free end 46 of the wall 44, for collecting overflow of water separated at the junction 32. The drain 42 is configured to drain water from the water trap 48.

Optionally, as shown in FIG. 3, a sponge 50 can be disposed in the conduit 26, and optionally specifically in the first flow path 28, for coalescing water from the mixture. In this example, a service door 52 can be disposed along the first flow path 28 of the conduit 26 for servicing and replacing the sponge 50. The sponge 50 can comprise a porous polymer for effectively coalescing water from the mixture.

Operation of the internal combustion engine 12 creates a vacuum that draws the mixture of air and water from the atmosphere surrounding the outboard motor 10 into the apparatuses 18*a*, 18*b* via the inlets 16*a*, 16*b* in the cowl 14, as shown at arrows A and then via the inlets 20 in the apparatuses 18*a*, 18*b*, as shown at arrows B. The mixture flows vertically downwardly through the first flow path 28, as shown at arrows C. Optionally, the mixture flows through sponge 50 wherein water from the mixture is coalesced from the air. Air mixed with water continues to flow downwardly as shown at arrows D into the junction 32 and around the noted 180-degree bend at lower end portion 36 of baffle 34. The 180-degree bend can be greater or less than 180 degrees. The 180-degree turn of the mixture of air and water allows both centrifugal and gravitational forces to further separate water from the mixture. Wall 44 further facilitates the noted separation such that water coalesced from the sponge 50 and separated at the junction 32 drains by gravity into drain 42 for discharge from the apparatuses 18*a*, 18*b* and ultimately from the outboard motor 10 via the drain 42 as shown at arrow E. During surges of high water content, such as when the outboard motor 10 is hit by a wave or a large amount of water spray, the water trap 48 is provided to collect water and prevent it from again mixing with air flow that has been separated from the water. Air continues to flow downstream of the junction 32 through the second flow path 30 as shown at arrows F and exits the outlet 22 to the noted space 24 between the cowl 14 and internal combustion engine 12 wherein it is drawn into the engine 12 for combustion.

The present disclosure thus provides an outboard motor 10 having port and starboard apparatuses 18*a*, 18*b* for intake of air to an internal combustion engine 12, with each apparatus 18*a*, 18*b* having an inlet 20 receiving a mixture of air and water from atmosphere surrounding the outboard motor 10 and an outlet 22 discharging air to a space 24 between the cowl 14 and the internal combustion engine 12. Means are provided for conveying the mixture between the inlet 20 and the outlet 22 such that both centrifugal and gravitational forces separate the water from the air as the mixture flows therethrough.

What is claimed is:

1. An apparatus for intake of air to an outboard motor, the apparatus comprising:

an inlet receiving a mixture of air and water from atmosphere surrounding the outboard motor and an outlet discharging the air;

a conduit extending between the inlet and the outlet, the conduit having a vertically downwardly oriented first flow path, a vertically upwardly oriented second flow path, and a junction joining the first and second flow paths, the junction oriented with respect to the first and second flow paths such that both centrifugal and gravitational forces separate the water from the air as the mixture flows therethrough;

a separator located at the junction for separating the water from the air, wherein the separator comprises a drain and a wall having a free end extending into the junction, and wherein the drain, receives and drains water from the separator.

2. An apparatus according to claim 1, comprising a baffle separating the first flow path from the second flow path, wherein the baffle comprises a lower end portion located at the junction.

3. An apparatus according to claim 2, wherein the lower end portion of the baffle comprises a curved outer surface for guiding airflow through the junction.

4. An apparatus according to claim 1, comprising a water trap located vertically higher than the free end of the wall for collecting overflow of water separated at the junction.

5. An apparatus according to claim 4, wherein the drain drains water from the water trap.

6. An apparatus according to claim 1, wherein the junction comprises a 180 degree bend.

7. An apparatus according, to claim 1, comprising a sponge disposed in the conduit for coalescing water from the mixture.

8. An apparatus according to claim 7, wherein the sponge is disposed in the first flow path.

9. An apparatus according to claim 7, comprising a service door provided in the conduit for servicing and replacing the sponge.

10. An apparatus according to claim 7, wherein the sponge comprises a porous polymer.

11. An apparatus according to claim 1, wherein the outlet discharges air to a space between a cowl and an internal combustion engine in the outboard motor.

12. An outboard motor comprising:

an internal combustion engine;

a cowl covering the internal combustion engine; and port and starboard apparatuses for intake of air to the internal combustion engine, each apparatus comprising an inlet receiving a mixture of air and water from atmosphere surrounding the outboard motor and an outlet discharging the air to a space between the cowl and the internal combustion engine; and a conduit extending between the inlet and the outlet, the conduit having, a vertically downwardly oriented first flow path, a vertically upwardly oriented second flow path, and a junction joining the first and second flow paths, the junction oriented with respect to the first and second flow paths such that both centrifugal and gravitational forces separate the water from the air as the mixture flows therethrough a separator located at the junction for separating the water from the air;

wherein the separator comprises a drain and a wall having a free end laterally extending into the junction;

wherein the drain receives and drains water from the separator.

13. An outboard motor according to claim 12, wherein the junction comprises a 180 degree bend.

14. An apparatus for intake of air to an outboard motor: the apparatus comprising:

an inlet receiving a mixture of air and water from atmosphere surrounding the outboard motor and an outlet discharging the air;

a conduit extending between the inlet and the outlet, the conduit having a vertically downwardly oriented first flow path, a vertically upwardly oriented second flow path, and a junction joining the first and second flow paths, the junction oriented with respect to the first and second flow paths such that both centrifugal and gravitational forces separate the water from the air as the mixture flows therethrough a baffle separating the first flow path from the second flow path, wherein the baffle comprises a lower end portion located at the junction;

a separator located at the junction for separating the water from the air, wherein the separator comprises a drain and a wall having a free end extending into the junction, wherein the wall is curved towards the junction and the free end of the wall laterally extends towards the first flow path and wherein the drain is disposed lower than the wall in the apparatus and receives and drains water from the separator.

15. The apparatus according to claim 14, comprising a water trap located vertically higher than the free end of the wall and between the free end of the wall and the conduit for collecting overflow of water separated at the junction.

* * * * *